US008246319B2

(12) United States Patent
Ohnishi

(10) Patent No.: US 8,246,319 B2
(45) Date of Patent: Aug. 21, 2012

(54) RECIPROCATING PUMP

(75) Inventor: Toshiaki Ohnishi, Togane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 620 days.

(21) Appl. No.: 12/269,539

(22) Filed: Nov. 12, 2008

(65) Prior Publication Data

US 2009/0123303 A1 May 14, 2009

(30) Foreign Application Priority Data

Nov. 13, 2007 (JP) ..... 2007-294761

(51) Int. Cl.
*F04B 1/26* (2006.01)

(52) U.S. Cl. ..... 417/273; 417/539; 92/171.1

(58) Field of Classification Search ..... 417/273, 417/454, 539, 568; 92/144, 168, 171.1; 137/315.33, 137/512, 539, 540
See application file for complete search history.

(56) References Cited

U.S. PATENT DOCUMENTS

| | | | | |
|---|---|---|---|---|
| 3,427,988 | A * | 2/1969 | Redman et al. | 417/569 |
| 4,264,286 | A * | 4/1981 | Reinkemeyer | 417/539 |
| 4,974,628 | A * | 12/1990 | Tepermeister et al. | 137/454.4 |
| 5,107,890 | A * | 4/1992 | Gute | 137/539 |
| 5,934,173 | A * | 8/1999 | Murphy et al. | 92/165 R |
| 7,364,412 | B2 * | 4/2008 | Kugelev et al. | 417/454 |
| 2004/0213677 | A1 * | 10/2004 | Matzner et al. | 417/63 |
| 2006/0140778 | A1 * | 6/2006 | Warren | 417/53 |
| 2007/0237651 | A1 * | 10/2007 | Tojo | 417/269 |

FOREIGN PATENT DOCUMENTS

| | | | |
|---|---|---|---|
| JP | 45-022562 | U | 9/1970 |
| JP | 47-010976 | A | 6/1972 |
| JP | 59-110475 | U | 7/1984 |
| JP | 62-107279 | A | 5/1987 |
| JP | 63-057879 | A | 3/1988 |
| JP | 01-013277 | U | 1/1989 |

(Continued)

OTHER PUBLICATIONS

Patent Abstracts of Japan, Publication No. 04-179872, Publication Date: Jun. 26, 1992, 1 page.

(Continued)

*Primary Examiner* — Devon C Kramer
*Assistant Examiner* — Dominick L Plakkoottam
(74) *Attorney, Agent, or Firm* — Osha Liang LLP

(57) ABSTRACT

The reciprocating pump for performing a pumping action by reciprocating an individual reciprocating member inside a plurality of cylinder sections arranged in parallel includes a seal case in which a cylinder section is formed and which functions as an independent pressure-resistant container; and a suction valve and a discharge valve in which a valve chamber is formed individually and each of which functions as an independent pressure-resistant container. The suction valve and the discharge valve are coupled so as to sandwich two planar sections from a direction perpendicular to a direction in which a plurality of cylinder sections are arranged in parallel in a state in which each of the suction valve and the discharge valve abuts against the respective one of the two planar sections of an external surface of a small diameter section at a front end side formed in the seal case, and the valve chamber is communicatively connected to the cylinder section. Thereby, the cylinder distance can be reduced while maintaining the thickness between cylinders and the assembling is facilitated.

5 Claims, 3 Drawing Sheets

FOREIGN PATENT DOCUMENTS

| | | | |
|---|---|---|---|
| JP | 04-179872 | A | 6/1992 |
| JP | 3423915 | | 4/2003 |
| JP | 2007-239596 | A | 9/2007 |

OTHER PUBLICATIONS

Notice of Reasons for Rejection for Japanese Application No. P2007-294761 mailed on Jan. 5, 2010 and English translation thereof, 5 pages.

Patent Abstracts of Japan for Japanese Publication No. 62-107279, Publication Date: May 18, 1987, 1 page.

English Abstract for Japanese Publication No. 45-22562, Publication Date: Sep. 7, 1970, 1 page.

Patent Abstracts of Japan for Japanese Publication No. 63-57879, Publication Date: Mar. 12, 1988, 1 page.

Office Action for Japanese Application No. 2007-294761 mailed on May 25, 2010, 1 page.

Patent Abstracts of Japan for Japanese Publication No. 2007-239596, Publication Date: Sep. 20, 2007, 1 page.

Partial English translation of Japanese Utility Model Application No. 01-013227, published on Jan. 24, 1989, 1 page.

Partial English translation of Japanese Utility Model Application No. 59-110475, published on Jul. 25, 1984, 1 page.

Office Action for Japanese Application No. 2007-294761 mailed on Sep. 28, 2010, 1 page.

Patent Abstracts of Japan for Japanese Publication No. 2001-271762, Publication date Oct. 5, 2001 (1 page).

* cited by examiner

RECIPROCATING PUMP

BACKGROUND OF THE INVENTION

1. Field of the Invention

The present invention relates to a reciprocating pump.

2. Related Background Art

Conventionally, as a reciprocating pump for pumping a liquid, there has been known a reciprocating pump having a plurality of pump chambers capable of applying a high pressure to a fluid (for example, see Japanese Patent No. 3423915). The reciprocating pump disclosed in the Patent Document is a triple plunger pump having three pump chambers and an individual plunger has a sleeve with a pump chamber formed therein. The sleeve is formed as an independent arrangement separated from the reciprocating pump body. The front end side thereof is connected to a valve body through a high pressure pipe joint and the back end side thereof is screw-fastened to a holder member. The holder member is bolt-attached to a crankcase of the reciprocating pump.

SUMMARY OF THE INVENTION

However, the above described reciprocating pump disclosed in the Patent Document is not suitable for downsizing since an individual sleeve having a cylinder therein has a male screw on an outer peripheral thereof, and is threaded into a holder member to form a triple pump chamber, which requires a thickness required to withstand the pressure between the three chambers as well as a thickness necessary for thread formation.

In order to solve such a technical problem, the present invention has been made, and an object of the present invention is to provide a reciprocating pump having a structure capable of being downsized and suitable for assembling.

The reciprocating pump in accordance with the present invention is a reciprocating pump which performs a pumping action by reciprocating an individual reciprocating member inside a plurality of cylinder sections arranged in parallel and is characterized by including a seal case in which a cylinder section is formed and which functions as an independent pressure-resistant container; and a suction valve and a discharge valve in which a valve chamber is formed individually and each of which functions as an independent pressure-resistant container, wherein the suction valve and the discharge valve are coupled so as to sandwich two planar sections from a direction perpendicular to a direction in which a plurality of cylinder sections are arranged in parallel in a state in which each of the suction valve and the discharge valve abuts against the respective one of the two planar sections of an external surface of a small diameter section at a front end side formed in the seal case, and the valve chamber is communicatively connected to the cylinder section.

The reciprocating pump in accordance with the present invention is coupled so as to sandwich the two planar sections from a direction perpendicular to a direction in which the cylinder sections are arranged in parallel in a state in which the seal case functioning as a pressure-resistant container, the suction valve and the discharge valve are abutted against each other through the two planar sections, and the cylinder section inside the seal case and the suction valve and the valve chambers inside the discharge valve are communicatively connected. Thereby, the cylinder distance can be reduced in comparison with the conventional distance while maintaining the thickness between cylinders, downsizing can be achieved in a direction of the cylinder sections arranged in parallel, and the assembling is facilitated.

Here, it is preferable that the reciprocating pump includes a front metal fitting storing a small diameter section at a front end side of the seal case and the valve; and a base metal fitting storing a back end side of the seal case, wherein the seal case is sandwiched between the front metal fitting and the base metal fitting; and the base metal fitting is provided at a position outside the seal case except a portion between the cylinder sections, and is coupled to a position rearward of the front metal fitting by means of a bolt which extends in an axial direction of the cylinder section.

As configured as above, the seal case may be sandwiched between the front metal fitting and the base metal fitting by means of the front metal fitting provided at the small diameter section at the front end side of the seal case and the base metal fitting provided at the back end side of the seal case and is coupled to a position rearward of the front metal fitting by means of a bolt which is provided at a position outside the seal case except the portions between the cylinder sections and extends in the axial direction of the cylinder section. Therefore, the cylinder distance can be reduced in comparison with the conventional distance while maintaining the thickness between cylinders, downsizing can be achieved in a direction of the cylinder sections arranged in parallel, and the assembling is facilitated.

Here, it is preferable that the valve is configured by unitizing a valve body for opening and closing a flow channel, a valve seat for seating and separating the valve body thereon and therefrom, an resilient body for urging the valve body in a direction to be seated, and a retention member for storing the valve body and the resilient body, wherein the front metal fitting has an insertion opening for storing a small diameter section of the seal case and a through-hole formed to penetrate in a direction perpendicular to the two planar sections and to be communicatively connected to the insertion opening; and the unitized valves are inserted and assembled into the through-hole of the front metal fitting, each being abutted against the two planar sections of the seal case inserted into the front metal fitting.

Thereby, the valves are unitized, the small diameter section of the seal case is inserted into the insertion opening formed in the front metal fitting, the through-hole is formed in the front metal fitting which penetrates in a direction perpendicular to the two planar sections and is communicatively connected to the insertion opening, each of the unitized valves is inserted and assembled into the through-hole. Therefore, it is easy to assemble the valves, the seal case, and the front metal fitting.

DESCRIPTION OF THE PREFERRED EMBODIMENTS

Figure 1:
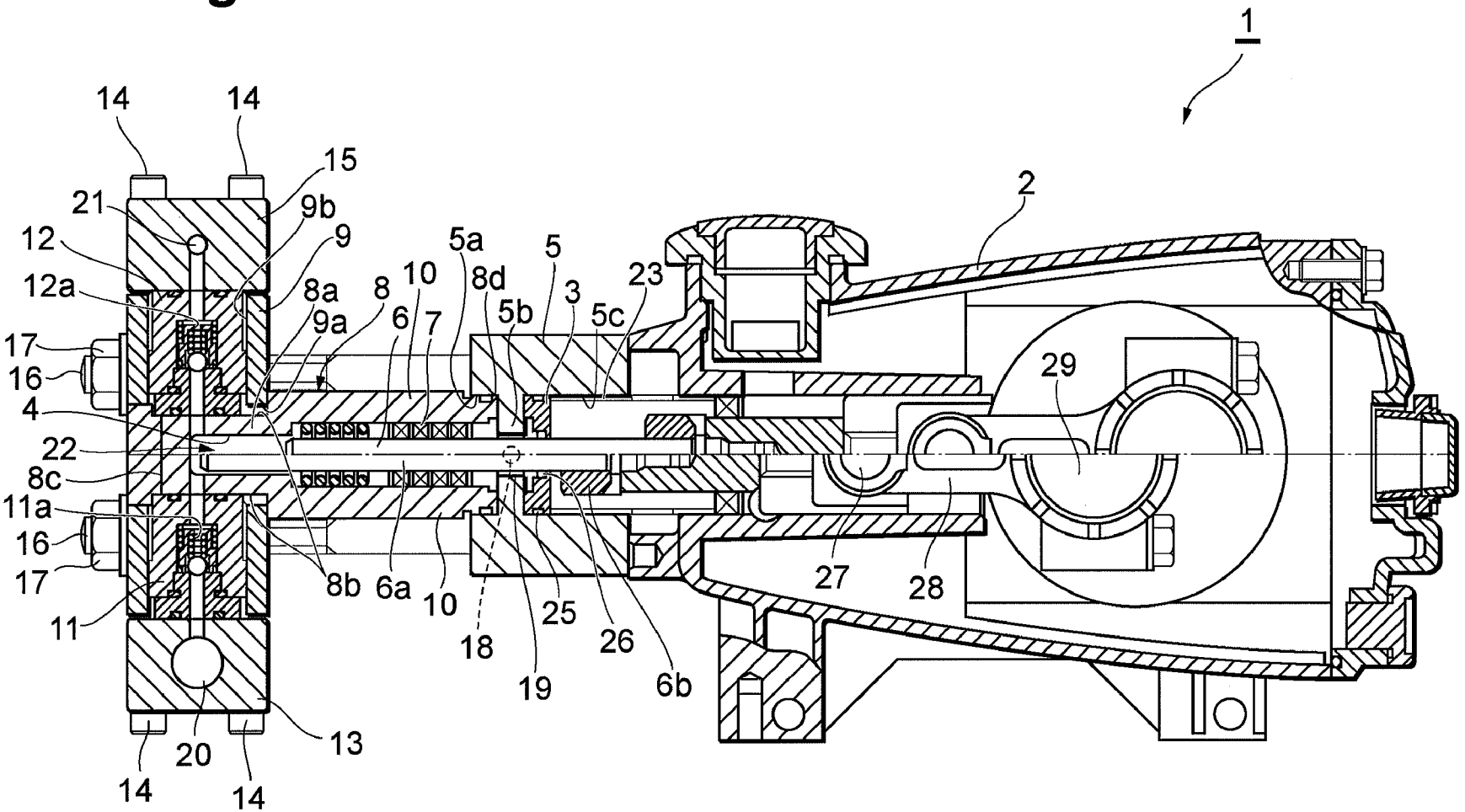
FIG. 1 is a longitudinal sectional view illustrating a reciprocating pump in accordance with an embodiment of the present invention.

Hereinafter, embodiments of the present invention will be described with reference to the accompanying drawings. It should be noted that in the description of the drawings, like reference characters refer to like elements and the duplicate description is omitted. Moreover, unless otherwise indicated, a vertical direction indicates the direction in the explanatory drawing.

Figure 2:
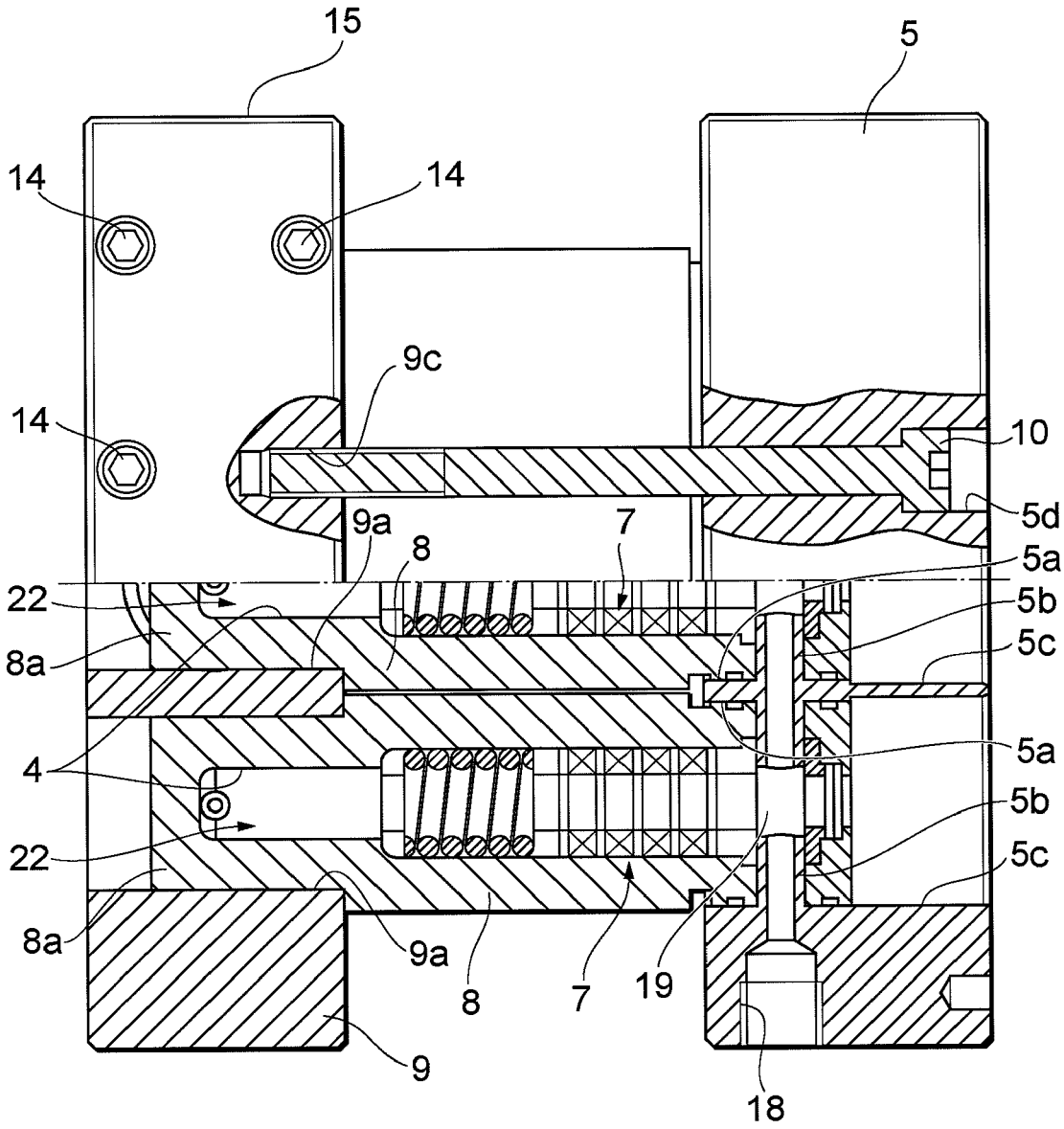
FIG. 2 is a partial sectional plan view of a front end of the reciprocating pump illustrated in FIG. 1.
Figure 3:
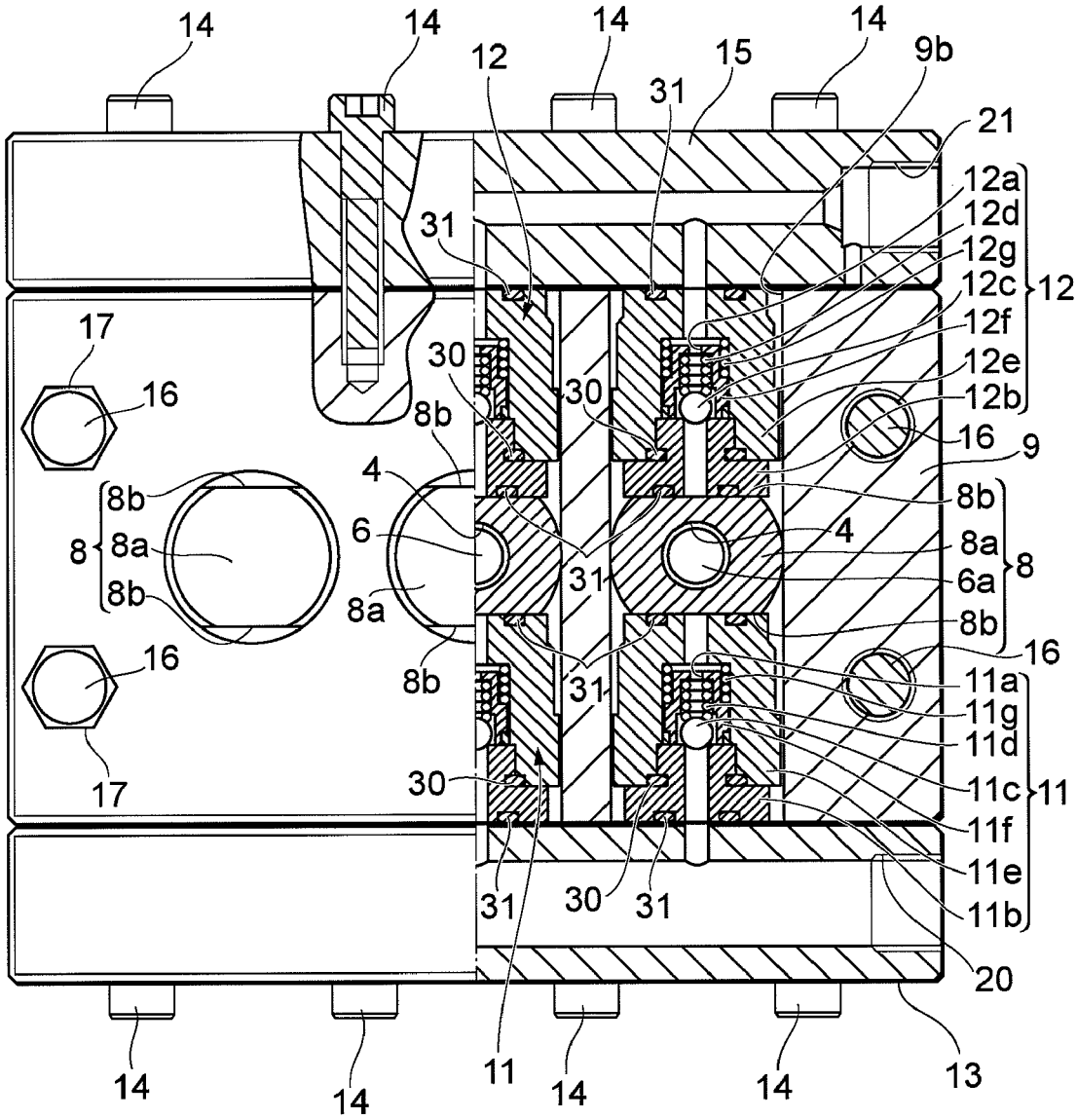
FIG. 3 is a partial sectional front view of the reciprocating pump illustrated in FIG. 1.

FIG. 1 is a longitudinal sectional view illustrating a reciprocating pump in accordance with an embodiment of the present invention; FIG. 2 is a partial sectional plan view of a front end of the reciprocating pump illustrated in FIG. 1; and FIG. 3 is a partial sectional front view of the reciprocating pump illustrated in FIG. 1. It should be noted that the upper side portion of the center line of a reciprocating member 6 illustrated in FIG. 1 indicates the reciprocating member 6 positioned at the bottom dead center, and the lower side portion thereof indicates the reciprocating member 6 positioned at the top dead center. Moreover, in order to avoid complicated notation, a plunger 6*a* is omitted in FIG. 2.

As shown in FIG. 1, the reciprocating pump 1 is a triple reciprocating pump having three reciprocating members 6 in a direction perpendicular to the plane of the paper, that is, a reciprocating pump for performing a pumping action of sucking and discharging a liquid by reciprocating the plunger 6*a* and a plunger rod 6*b*, each constituting a reciprocating member 6, (in the left and right direction in FIG. 1), which is configured by coupling individual block-shaped elements instead of a conventional integral manifold, as the detail will be described later.

The reciprocating member 6 is configured such that the front end side of the plunger rod 6*b* is coupled to the back end side of the cylindrical plunger 6*a* so as to reciprocate integrally. As shown in FIGS. 2 and 3, the reciprocating pump 1 having three reciprocating members 6 includes three cylindrical seal cases 8 in the direction perpendicular to the plane of the paper in FIG. 1, so as to reciprocate one plunger 6*a* in each seal case 8. Further, as shown in FIG. 1, the reciprocating pump 1 includes a base metal fitting 5 and a crankcase 2 at the back end side of these seal cases 8 thereof so as to reciprocate the respective plunger rods 6*b* thereinside. The detail description of coupling the seal cases 8, the base metal fitting 5, and the crankcase 2 will be given later.

A cylinder section 4 is formed in each of the seal cases 8 so as to reciprocate the plunger 6*a* thereinside and a pump chamber 22 is formed at the front end side of the cylinder section 4. The individual seal case 8 is configured to function as an independent pressure-resistant container. A small diameter section 8*a* having two planar sections 8*b* facing each other in the vertical direction is formed on an external surface of the front end 8*c* side of an individual seal case 8. In addition, a plurality of annular high-pressure packings 7 are arranged adjacently in the axial direction at the back end side of an individual cylinder section 4 inside the seal case 8 so as to be liquid-tightly in sliding contact with the outer peripheral surface of the plunger 6*a*.

A crankshaft 29 functioning as a driving source of the individual reciprocating member 6 is provided inside the crankcase 2 located at the backward of the seal case 8 through the base metal fitting 5. When the crankshaft 29 is rotated, through a con rod 28 and a piston pin 27 provided corresponding to the individual reciprocating member 6, the individual plunger rod 6*b* and the plunger 6*a* are configured to be reciprocated integrally inside the individual cylinder section 4 such that the individual plunger 6*a* pressurizes or depressurizes the individual pump chamber 22.

Moreover, the base metal fitting 5 into which the plunger rod 6*b* is inserted is coupled at the front side of the crankcase 2. The base metal fitting 5 has an annular flange section 5*b* projected inward in the middle of the tube in the axial direction. A seal case 3 is stored in a large-diameter opening 5*c* formed at the back side thereof. An annular low-pressure seal 26 is provided in the seal case 3 so as to be liquid-tightly in sliding contact with the outer peripheral surface of the plunger 6*a*. An O ring 25 is provided between the outer peripheral surface of the seal case 3 and the inner peripheral surface of the base metal fitting 5. Further, a cylindrical collar 23 is provided so as not to vibrate the low-pressure seal 26 by pressing the seal case 3 in the axial direction to abut against the flange section 5*b*. Still further, a large-diameter opening 5*a* is opened at the front side of the flange section 5*b* of the base metal fitting 5, and the back end 8*d* of the seal case 8 is inserted into the opening 5*a* so as to abut against the flange section 5*b*. A clearance gap 19 is provided between the flange section 5*b* and the plunger 6*a*. The clearance gap is used as a cooling channel 19 which is configured to communicatively connect between the high-pressure packing 7 and the low-pressure seal 26. When a liquid flows into an injection channel 18 which is opened at the side surface of the base metal fitting 5 and extends inward and the cooling channel 19, the reciprocating plunger 6*a*, the high-pressure packing 7, and the low-pressure seal 26 are configured to be cooled.

On the other hand, a front metal fitting 9 storing a small diameter section 8*a* of the seal case 8, a suction valve 11, a discharge valve 12 is provided at the front end 8*c* side of the seal case 8.

The front metal fitting 9 is formed into a substantially box shape and has three insertion openings 9*a* each having the same shape as the cross section of the small diameter section 8*a* of the seal case 8 corresponding to an individual seal case 8, and the above described small diameter section 8*a* of the seal case 8 is inserted into the insertion openings 9*a*.

Moreover, the front metal fitting 9 has a through-hole 9*b* having the same cross-sectional shape as the suction valve 11 and the discharge valve 12 of the individual cylinder section 4 in the vertical direction of FIG. 1, and is configured such that the suction valve 11 and the discharge valve 12 are stored in the through-hole 9*b* so as to sandwich the small diameter section 8*a* of the seal case 8 therebetween in the vertical direction, and to abut against the two planar section 8*b* of the small diameter section 8*a* of the seal case 8 respectively, and the valve chambers 11*a* and 12*a* formed inside the suction valve 11 and the discharge valve 12 are vertically connected communicatively to the cylinder section 4. The suction valve 11 functions as a check valve which allows only one-way flow from a suction opening 20 (described later) into an individual pump chamber 22. The discharge valve 12 functions as a check valve which allows only one-way flow from the individual pump chamber 22 into a discharge opening 21 (described later). The suction valve 11 and the discharge valve 12 in which valve chambers 11*a* and 12*a* are formed are unitized so as to function an independent pressure-resistant container having the flowing components. More specifically, spherical ball valves 11*c* and 12*c* are each functioning as a valve body for opening and closing the valve chambers 11*a* and 12*a*, springs 11*d* and 12*d* each functioning as an resilient body urge the ball valves 11*c* and 12*c* in a direction so as to be seated on valve seats 11*b* and 12*b*, valve sacks 11*f* and 12*f* store the springs 11*d* and 12*d* therein and guide the valve bodies 11*c* and 12*c*, springs 11*g* and 12*g* each functioning as an resilient body urge the valve sacks 11*f* and 12*f* in a direction so as to press against the valve seats 11*b* and 12*b*, and retention members 11*e* and 12*e* store the ball valves 11*c* and 12*c*. All of them are threadedly coupled liquid-tightly through an O ring 30 with the valve seats 11*b* and 12*b* so as to be configured as one unit.

Further, manifolds 13 and 15 are provided individually on the front metal fitting 9 so as to sandwich the suction valve 11, the discharge valve 12, and the front metal fitting 9 from the vertical direction. The manifold 13 has a suction opening 20 formed so as to extend horizontally and communicatively connect to the individual pump chamber 22 and valve chamber 11*a* arranged in parallel in the vertical direction; and the manifold 15 has a discharge opening 21 formed so as to extend horizontally and communicatively connect to the individual pump chamber 22 and valve chamber 12*a* arranged in parallel in the vertical direction.

As configured above, the reciprocating pump 1 is configured to allow a liquid to flow through the suction opening 20, the valve chamber 11*a*, the pump chamber 22, the valve chamber 12*a*, and discharge opening 21 in that order from downward to upward as illustrated in FIG. 1.

Then, the individual block-shaped components of the reciprocating pump 1 having such a configuration are coupled as described below.

That is, the small diameter section 8*a* of the individual seal case 8 is inserted into the insertion opening 9*a* of the front metal fitting 9, the back end 8*d* side of the individual seal case 8 is inserted into the opening 5*a* of the base metal fitting 5, and in this state, a horizontally extending bolt 10 is used to couple the front metal fitting 9, the seal case 8, and the base metal fitting 5. More specifically, as shown in FIG. 2, the bolt 10 is inserted into the through-hole 5*d* which is formed in the base metal fitting 5 and extends in the axial direction of the seal case 8, and is threadably secured into the female screw section 9*c* provided at the back portion of the front metal fitting 9 so as to couple the seal case 8 in a state where the seal case 8 is sandwiched between the front metal fitting 9 and the base metal fitting 5. It should be noted that a plurality of through-holes 5*d* are provided at a position outside the seal case 8 except the portions between the individual cylinder sections 4 along the axial direction of the seal case 8.

Then, in the state where the seal case 8 is sandwiched between the front metal fitting 9 and the base metal fitting 5, as shown in FIG. 1, each of the unitized suction valve 11 and discharge valve 12 is inserted into the through-hole 9*b* of the front metal fitting 9 respectively so as to abut against the two planar sections 8*b* of the individual seal case 8, and the valve chambers 11*a* and 12*a* of the suction valve 11 and the discharge valve 12 are communicatively connected to the cylinder section 4. In this state, the manifold 13 is abutted against the suction valve 11 so as to couple the manifold 13 and the front metal fitting 9 by means of a bolt 14, and the manifold 15 is abutted against the discharge valve 12 so as to couple the manifold 15 and the front metal fitting 9 by means of the bolt 14. Thereby, the front metal fitting 9, the base metal fitting 5, the individual seal case 8, and the individual suction valve 11, the individual discharge valve 12, and the manifolds 13 and 15 are integrally coupled. It should be noted that an O ring 31 is provided between the seal case 8 and the suction valve 11, the seal case 8 and the discharge valve 12, as well as between the suction valve 11 and the manifold 13, and between the discharge valve 12 and the manifold 15 so as to be liquid-tightly coupled.

Then, the assemblage of these components is fitted into the crankcase 2. In this case, by taking care not to damage the plunger 6*a* already built into the crankcase 2, the plunger 6*a* is inserted into the seal case 8 from the opening 5*c* side of the base metal fitting 5, a lock nut 17 is threaded from the front metal fitting 9 side into a bolt 16 which is embedded in the crankcase 2 and extends toward the front end side so as to couple the above assemblage to the crankcase 2.

The reciprocating pump 1 in accordance with the present embodiment obtained as described above is coupled so as to sandwich the two planar sections 8*b* and 8*b* from a direction perpendicular to a direction in which the cylinder sections 4 arranged in parallel in a state where the seal case 8 functioning as a pressure-resistant container, the suction valve 11, and the discharge valve 12 are abutted against each other through the two planar sections 8*b* and 8*b*, and the cylinder section 4 inside the seal case 8 and the suction valve 11 and the valve chambers 11*a* and 12*a* inside the discharge valve 12 are communicatively connected. Therefore, the cylinder distance can be reduced in comparison with the conventional distance while maintaining the thickness between cylinders, downsizing can be achieved in a direction of the cylinder sections 4 arranged in parallel, and the assembling is facilitated as described above.

Moreover, the reciprocating pump 1 in accordance with the present embodiment is configured such that the seal case 8 is sandwiched between the front metal fitting 9 and the base metal fitting 5 by means of the front metal fitting 9 provided at the small diameter section 8*a* at the front end 8*c* side of the seal case 8 and the base metal fitting 5 provided at the back end side of the seal case 8 and is coupled to a position rearward of the front metal fitting 9 by means of the bolt 10 which extends in the axial direction of the cylinder section 4 so as to sandwich the two planar sections 8*b* and 8*b*. Therefore, the cylinder distance can be reduced in comparison with the conventional distance while maintaining the thickness between cylinders, downsizing can be achieved in a direction of the cylinder sections 4 arranged in parallel, and the assembling is facilitated as described above.

Moreover, the reciprocating pump 1 in accordance with the present embodiment is configured such that the valves 11 and 12 are unitized, the small diameter section 8*a* of the seal case 8 is inserted into the insertion opening 9*a* formed in the front metal fitting 9, the through-hole 9*b* is formed in the front metal fitting 9 which penetrates in a direction perpendicular to the two planar sections 8*b* and 8*b* and is communicatively connected to the insertion opening 9*a*, each of the unitized valves 11 and 12 is inserted and assembled into the through-hole 9*b*. Therefore, it is easy to assemble the valves 11 and 12, the seal case 8, and the front metal fitting 9.

Further, the reciprocating pump 1 in accordance with the present embodiment can provide a reciprocating pump having a structure capable of being downsized and suitable for assembling the same.

Hereinbefore, the preferred embodiment of the present invention has been described in detail, but the reciprocating pump in accordance with the present invention is not limited to the reciprocating pump in accordance with the above embodiment. For example, a multiple cylinder reciprocating pump having two or four or more cylinder sections may be used.

What is claimed is:

1. A reciprocating pump for performing a pumping action by reciprocating members, each of which reciprocates inside one of a plurality of cylinder sections arranged in parallel, the reciprocating pump comprising:

a seal case, in which one of said cylinder sections is formed, the seal case functioning as an independent pressure-resistant container;

a suction valve and a discharge valve in which a valve chamber is formed individually, each of the valves functioning as an independent pressure-resistant container; and a front metal casing for storing a small diameter section at a front end side of the seal case, and the suction and discharge valves, a base metal casing for storing a back end side of said seal case;

wherein said seal case is sandwiched between said front metal casing and said base metal casing;

wherein said front metal casing and said based metal casing are coupled by a bolt;

wherein said suction valve and said discharge valve are coupled so as to sandwich two planar sections from a direction perpendicular to a direction in which the plurality of cylinder sections are arranged in parallel in a state in which each of said suction valve and said discharge valve abuts against the respective one of said two planar sections of an external surface of the small diameter section at a front end side formed in said seal case, and each of the valve chambers formed in the suction and discharge valves is communicatively connected to one of the plurality of cylinder sections;

wherein each of said suction and discharge valves is configured by unitizing a valve body for opening and closing a flow channel, a valve seat for seating and separating said valve body thereon and therefrom, an resilient body for urging said valve body in a direction to be seated, and a retention member for storing said valve body and said resilient body;

wherein said front metal casing has an insertion opening for storing the small diameter section of said seal case and a through-hole formed to penetrate in a direction perpendicular to said two planar sections and to be communicatively connected to said insertion opening; and wherein the unitized valves are inserted and assembled into said front metal casing, each being abutted against said two planar sections of said seal case inserted into said front metal casing.

2. The reciprocating pump according to claim 1, wherein said base metal casing is provided at a position outside the said seal case except a portion between said cylinder sections, and is coupled to a position rearward of said front metal casing by a bolt which extends in an axial direction of the one of the plurality of cylinder sections.

3. The reciprocating pump according to claim 2, wherein the base metal casing has an annular flange section projected inward in the middle of a tube, the reciprocating member is inserted into the base metal casing, and a clearance gap is provided between the annular flange section and the reciprocating member, and the clearance gap is used as a channel for guiding a cooling liquid to the reciprocating member.

4. The reciprocating pump according to claim 1, further comprising a first manifold and a second manifold provided on the front metal casing, such that the first and second manifolds sandwich the suction valve, the discharge valve, and the front metal casing from the direction, from which said suction valve and discharge valves sandwich the two planar sections;

wherein the first manifold is abutted against the suction valve and is coupled to the front metal casing by a bolt, and the second manifold is abutted against the discharge valve and is coupled to the front metal casing by a bolt.

5. The reciprocating pump according to claim 4, wherein an assemblage is constituted by integrally coupling the front metal casing, the base metal casing, the seal case, the suction valve, the discharge valve, and the manifolds; and wherein a lock nut is threaded from the front metal fitting casing side into a bolt which is embedded in a crankcase and extends toward the front end side so as to couple the assemblage to the crankcase.

* * * * *